US008157927B2

(12) United States Patent
Enokido et al.

(10) Patent No.: US 8,157,927 B2
(45) Date of Patent: Apr. 17, 2012

(54) RAW MATERIAL ALLOY FOR R-T-B SYSTEM SINTERED MAGNET, R-T-B SYSTEM SINTERED MAGNET AND PRODUCTION METHOD THEREOF

(75) Inventors: Yasushi Enokido, Tokyo (JP); Chikara Ishizaka, Tokyo (JP); Gouichi Nishizawa, Tokyo (JP)

(73) Assignee: TDK Corporation, Tokyo (JP)

( * ) Notice: Subject to any disclaimer, the term of this patent is extended or adjusted under 35 U.S.C. 154(b) by 125 days.

(21) Appl. No.: 12/646,593

(22) Filed: Dec. 23, 2009

(65) Prior Publication Data

US 2010/0111746 A1 May 6, 2010

Related U.S. Application Data

(62) Division of application No. 11/337,356, filed on Jan. 23, 2006, now abandoned.

(30) Foreign Application Priority Data

Jan. 25, 2005 (JP) ..... 2005-016365
Mar. 24, 2005 (JP) ..... 2005-086100

(51) Int. Cl.
*H01F 1/057* (2006.01)

(52) U.S. Cl. ..... 148/101; 148/103; 419/12
(58) Field of Classification Search ..... None
See application file for complete search history.

(56) References Cited

U.S. PATENT DOCUMENTS

2004/0163737 A1* 8/2004 Tomizawa et al. ..... 148/302
2005/0016632 A1* 1/2005 Tomizawa et al. ..... 148/105
2005/0067058 A1* 3/2005 Fujimori et al. ..... 148/302
2005/0097989 A1* 5/2005 Sekine ..... 75/334
2006/0016515 A1* 1/2006 Tomizawa et al. ..... 148/101

FOREIGN PATENT DOCUMENTS

EP 1189245 A2 3/2002
EP 1408518 A2 4/2004
EP 06001403 12/2007
JP 60-221551 11/1985
JP 05-211102 8/1993
JP 05-222488 8/1993
JP 05-295490 11/1993
JP 09-020954 1/1997
JP 2000-188213 7/2000

* cited by examiner

*Primary Examiner* — John Sheehan
(74) *Attorney, Agent, or Firm* — Dariush G. Adli; Adli Law Group P.C.

(57) ABSTRACT

It is an object of the present invention to obtain a highly coercive R-T-B system sintered magnet by making the crystal microstructure of a raw material alloy prepared by strip casting more uniform, thereby making the crushed powder obtained from such raw material alloy more fine and making the size distribution more narrow. The present invention provides a raw material alloy for an R-T-B system sintered magnet containing grains of an $R_2T_{14}B$ compound, wherein a P and/or S content is between 100 and 950 ppm. This raw material alloy preferably has a composition comprising 25 to 35% by weight of R, 0.5 to 4% by weight of B, 0.02 to 0.6% of one or both of Al and Cu, 5% by weight or less of Co, and the balance of Fe.

7 Claims, 12 Drawing Sheets

| Sample No. | Raw Material Alloy | | | Pulverized Powder Particle size(μm) | | | | Sintered Body | | | | |
|---|---|---|---|---|---|---|---|---|---|---|---|---|
| | P Content (ppm) | S Content (ppm) | P+S (ppm) | D10 | D50 | D90 | D90−D10 | P Content (ppm) | S Content (ppm) | P+S (ppm) | Br (G) | iHc (Oe) |
| 1 | 71 | 53 | 124 | 1.37 | 6.10 | 21.66 | 20.29 | 19 | 12 | 31 | 12647 | 23378 |
| 2 | 141 | 105 | 246 | 1.68 | 5.80 | 16.06 | 14.38 | 38 | 26 | 64 | 12646 | 23615 |
| 3 | 611 | 105 | 716 | 1.46 | 4.30 | 10.12 | 8.66 | 130 | 31 | 161 | 12651 | 24488 |
| 4 | 188 | 560 | 748 | 1.55 | 4.10 | 8.68 | 7.13 | 42 | 157 | 199 | 12642 | 24853 |
| 5 | 517 | 385 | 902 | 1.37 | 3.50 | 7.18 | 5.81 | 116 | 104 | 220 | 12633 | 25211 |
| 6 | 94 | 875 | 969 | 1.13 | 2.70 | 5.17 | 4.04 | 22 | 250 | 272 | 12545 | 25748 |
| 7 | 1410 | 10 | 1420 | 1.12 | 2.40 | 4.10 | 2.98 | 300 | 10 | 310 | 12498 | 25906 |

FIG. 1

| Sample No. | Raw Material Alloy | | | Pulverized Powder Particle size(μm) | | | | Sintered Body | | | | |
|---|---|---|---|---|---|---|---|---|---|---|---|---|
| | P Content (ppm) | S Content (ppm) | P+S (ppm) | D10 | D50 | D90 | D90-D10 | P Content (ppm) | S Content (ppm) | P+S (ppm) | Br (G) | iHc (Oe) |
| 1 | 71 | 53 | 124 | 1.37 | 6.10 | 21.66 | 20.29 | 19 | 12 | 31 | 12647 | 23378 |
| 2 | 141 | 105 | 246 | 1.68 | 5.80 | 16.06 | 14.38 | 38 | 26 | 64 | 12646 | 23615 |
| 3 | 611 | 105 | 716 | 1.46 | 4.30 | 10.12 | 8.66 | 130 | 31 | 161 | 12651 | 24488 |
| 4 | 188 | 560 | 748 | 1.55 | 4.10 | 8.68 | 7.13 | 42 | 157 | 199 | 12642 | 24853 |
| 5 | 517 | 385 | 902 | 1.37 | 3.50 | 7.18 | 5.81 | 116 | 104 | 220 | 12633 | 25211 |
| 6 | 94 | 875 | 969 | 1.13 | 2.70 | 5.17 | 4.04 | 22 | 250 | 272 | 12545 | 25748 |
| 7 | 1410 | 10 | 1420 | 1.12 | 2.40 | 4.10 | 2.98 | 300 | 10 | 310 | 12498 | 25906 |

FIG. 5

| Sample No. | Raw Material Alloy | | | Pulverized Powder Particle size(μm) | | | | Sintered Body | | | | |
|---|---|---|---|---|---|---|---|---|---|---|---|---|
| | P Content (ppm) | S Content (ppm) | P+S (ppm) | D10 | D50 | D90 | D90−D10 | P Content (ppm) | S Content (ppm) | P+S (ppm) | Br (G) | iHc (Oe) |
| 8 | 48 | 59 | 107 | 1.25 | 5.99 | 23.03 | 21.78 | 11 | 15 | 26 | 14834 | 12321 |
| 9 | 126 | 139 | 265 | 1.52 | 5.56 | 16.22 | 14.70 | 28 | 32 | 60 | 14801 | 12366 |
| 10 | 231 | 397 | 628 | 1.46 | 4.52 | 11.23 | 9.77 | 67 | 98 | 165 | 14772 | 12941 |
| 11 | 425 | 229 | 654 | 1.53 | 4.30 | 9.67 | 8.14 | 114 | 58 | 172 | 14752 | 13104 |
| 12 | 402 | 402 | 804 | 1.60 | 4.10 | 8.41 | 6.81 | 120 | 98 | 218 | 14731 | 13178 |
| 13 | 281 | 822 | 1103 | 1.50 | 3.57 | 6.81 | 5.32 | 67 | 203 | 270 | 14397 | 13475 |
| 14 | 882 | 356 | 1238 | 1.31 | 2.77 | 4.70 | 3.39 | 224 | 87 | 311 | 14245 | 13479 |

FIG. 9

| Sample No. | Raw Material Alloy | | | Pulverized Powder Particle size(μm) | | | | Sintered Body | | | | |
|---|---|---|---|---|---|---|---|---|---|---|---|---|
| | P Content (ppm) | S Content (ppm) | P+S (ppm) | D10 | D50 | D90 | D90-D10 | P Content (ppm) | S Content (ppm) | P+S (ppm) | Br (G) | iHc (Oe) |
| 15 | 77 | 39 | 116 | 1.25 | 6.24 | 24.95 | 23.71 | 20 | 11 | 31 | 14101 | 14308 |
| 16 | 152 | 41 | 193 | 1.53 | 5.93 | 18.36 | 16.83 | 42 | 13 | 55 | 14078 | 14749 |
| 17 | 399 | 189 | 588 | 1.59 | 5.12 | 13.19 | 11.60 | 88 | 53 | 141 | 14052 | 14899 |
| 18 | 402 | 342 | 744 | 1.77 | 4.78 | 10.31 | 8.54 | 110 | 96 | 206 | 14047 | 15142 |
| 19 | 311 | 526 | 837 | 1.69 | 4.34 | 8.90 | 7.20 | 78 | 141 | 219 | 14028 | 15107 |
| 20 | 769 | 428 | 1197 | 1.65 | 3.98 | 7.68 | 6.03 | 187 | 101 | 288 | 13885 | 15195 |
| 21 | 1021 | 430 | 1451 | 1.41 | 3.01 | 5.15 | 3.74 | 245 | 99 | 344 | 13799 | 15592 |

RAW MATERIAL ALLOY FOR R-T-B SYSTEM SINTERED MAGNET, R-T-B SYSTEM SINTERED MAGNET AND PRODUCTION METHOD THEREOF

BACKGROUND OF THE INVENTION

1. Field of the Invention

The present invention relates to a raw material alloy used in the production of an R-T-B system sintered magnet, an R-T-B system sintered magnet and a production method thereof. Here, R represents one or more elements selected from rare earth elements, and T represents one or more elements selected from transition metal elements and comprises Fe, or Fe and Co.

2. Description of the Related Art

The basic production process of an R-T-B system sintered magnet comprises: preparation of the raw material alloy; crushing of the obtained raw material alloy; compacting the crushed alloy powder in a magnetic field; and sintering and aging. Various approaches in the respective production steps have been attempted to improve the magnetic properties of an R-T-B system sintered magnet. For example, the approaches include lowering the atmospheric oxygen content in the production process to lower the oxygen content in the sintered body, using multiple (normally two) raw material alloys and the like. As will be described below, among such approaches investigations are being conducted into improving magnetic properties by improving the microstructure of the raw mother alloy.

Raw material alloys have conventionally been prepared using metal mold casting, that is, ingot casting and strip casting which uses a cooling roll to quench a molten alloy.

The formation of α-Fe cannot be avoided in an alloy prepared by an ingot method, which causes the crushing efficiency of the alloy to dramatically decline, whereby the magnetic properties of the ultimately obtained magnet are poor. To overcome this problem, it is known that α-Fe can be eliminated by solution-treating the alloy obtained in the ingot method. However, carrying out solution-treating can cause a drop in productivity and an increase in production costs.

On the other hand, α-Fe hardly forms at all in an alloy prepared by strip casting (e.g. Japanese Patent Laid-Open No. 5-222488 (Patent Document 1) and Japanese Patent Laid-Open No. 5-295490 (Patent Document 2)), which is one kind of rapid solidification. The resulting alloy has a grain size from 20 to 30 μm along the minor axis direction and up to about 300 μm along the major axis direction, meaning that a comparatively fine microstructure is formed.

SUMMARY OF THE INVENTION

While a raw material alloy prepared by strip casting possesses a fine microstructure as described above, even if such a raw material alloy is crushed under fixed conditions, the particle size distribution of the crushed powder is variable. The microstructure of an R-T-B system sintered magnet obtained by compacting of a crushed alloy powder having a variable particle size distribution in a magnetic field, and subsequent sintering of the compacted body, will also be uneven, whereby the magnetic properties, especially coercive force, deteriorate. Further, there is also the problem that there is a greater variation in coercive force.

The present invention was created in view of such technical problems, wherein it is an object to obtain a highly coercive R-T-B system sintered magnet by making the microstructure of a raw material alloy prepared by strip casting more uniform, thereby making the crushed powder obtained from such raw material alloy finer and making the particle size distribution more narrow.

In order to make the microstructure of a raw material alloy prepared by strip casting more uniform, the strip prepared by strip casting has to be cooled more uniformly. That is, if the thickness of the molten alloy fed to the roll is thick, cooling performance differs in the thickness direction, whereby uniform cooling, in other words obtaining a uniform microstructure, becomes harder to achieve. To make the molten alloy thinner for feeding to the roll, the present inventor thought that the viscosity of the alloy in a molten state was important. That is, if the molten alloy viscosity is low, the alloy fed to the roll can be made thinner, so that as a consequence a raw material alloy having a uniform microstructure can be provided by strip casting. To lower the viscosity of the molten alloy, P (phosphorous) and S (sulfur) are effective. Furthermore, it was learned that P (phosphorous) and S (sulfur) can be decreased to a level which does not adversely impact on magnetic properties during the sintering process, even if a considerable amount of P and S is present in the raw material alloy. Thus, P and/or S are effective elements for achieving the object according to the present invention.

That is, the raw material alloy for an R-T-B system sintered magnet (hereinafter, "raw material alloy") according to the present invention comprises grains comprising an $R_2T_{14}B$ compound, and a P and/or S content from 100 to 950 ppm. Here, R represents one or more elements selected from rare earth elements, and T represents one or more elements selected from transition metal elements and comprises Fe, or Fe and Co. R and T will be thus defined below.

In the raw material alloy according to the present invention, the P and/or S content is preferably between 200 and 750 ppm, and more preferably between 300 and 700 ppm.

In the raw material alloy according to the present invention, the composition is preferably such that R is 25 to 35% by weight, B is 0.5 to 4% by weight, that one or both of Al and Cu are 0.02 to 0.6%, Co is 5% by weight or less, and the remaining is Fe and unavoidable impurities. This composition further preferably comprises 2% by weight or less of one or more of Zr, Nb and Hf.

The R-T-B system sintered magnet according to the present invention comprises a sintered body having grains comprising an $R_2T_{14}B$ compound as a main phase, wherein the sintered body has a P and/or S content between 10 and 220 ppm. The P and/or S content in the sintered body is preferably between 50 and 200 ppm, and more preferably between 50 and 180 ppm.

The composition of the R-T-B system rare earth sintered magnet according to the present invention, generally, is the same as that of the raw material alloy, although O (oxygen) contained in the sintered body is preferably 3,000 ppm or less so that high magnetic properties can be attained. If O is made to be 3,000 ppm or less, 2% by weight or less of one or more of Zr, Nb and Hf is preferably incorporated in the sintered body.

By employing the above raw material alloy according to the present invention, a method for producing an R-T-B system sintered magnet, comprising a sintered body having grains of an $R_2T_{14}B$ compound as a main phase, can be provided comprising the steps of: crushing a raw material alloy, which has a P and/or S content between 100 and 950 ppm, and has been prepared by strip casting, into a powder having a prescribed particle size; compacting the resulting powder in a magnetic field to fabricate a compacted body; and sintering the compacted body to obtain the sintered body having a P and/or S content between 10 and 220 ppm.

In such an R-T-B system sintered magnet the preferable P and/or S content in the raw material alloy, and preferable P and/or S content in the sintered body, are as described above. The fact that if the O (oxygen) contained in the sintered body is preferably 3,000 ppm or less for attaining good magnetic properties is also the same.

According to the present invention, by setting the amount of P and/or S contained in the strip cast raw material alloy to between 100 and 950 ppm, the raw material alloy microstructure is uniform and fine, wherein even the pulverized powder which is to undergo compacting in a magnetic field can be made to have a fine and sharp particle size distribution. As a result, the magnetic properties, especially coercive force, of the obtained R-T-B system sintered magnet can be improved. Further, the P and S content is lowered to between 10 and 220 ppm as a result of the sintering, whereby a high residual magnetic flux density can be attained.

BRIEF DESCRIPTION OF THE DRAWINGS

FIG. 1 is a table showing the raw material alloy specification and the results regarding magnetic properties for Example 1;

FIG. 5 is a table showing the raw material alloy specification and the results regarding magnetic properties for Example 2;

FIG. 9 is a table showing the raw material alloy specification and the results regarding magnetic properties for Example 3;

DETAILED DESCRIPTION OF THE PREFERRED EMBODIMENTS

Figure 2:
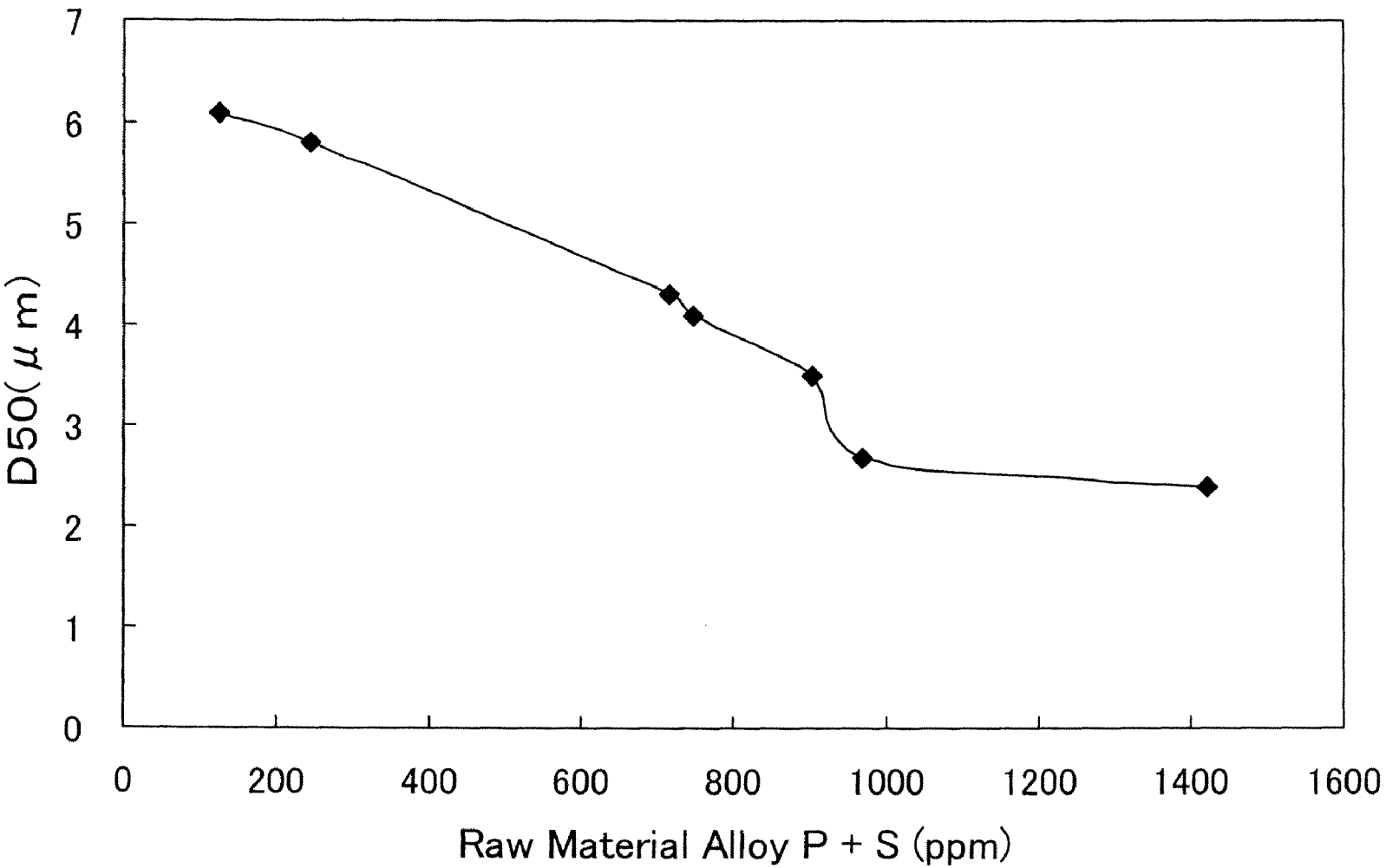
FIG. 2 is a graph illustrating the relationship between P and/or S content in the raw material alloy of Example 1 and D50.

The raw material alloy according to the present invention comprises grains comprising an $R_2T_{14}B$ compound, where in P and/or S content is between 100 and 950 ppm. In the present invention, the P and/or S have an effect of making the microstructure of the raw material alloy obtained by reducing the viscosity of the molten alloy more uniform and fine. As a result, the particle size of the pulverized powder obtained by the subsequent pulverizing is small, and the particle size distribution is sharp. This means that the magnetic properties, especially coercive force, of the R-T-B system sintered magnet obtained by using such a pulverized powder are improved, and that variation in the coercive force of the R-T-B system sintered magnet can be suppressed.

Here, if the molten alloy viscosity decreases, the strip-shaped alloy can be thinner. In strip casting, when the molten metal is in contact with the revolving roll, the molten alloy is cooled at the contact with the roll, and develops columnar crystals. If the alloy in contact with the roll is thick, cooling takes time, whereby crystals grow in a horizontal direction on the side which is not in contact with the roll. For this reason, the further away from the roll the more that column-shaped crystals are formed having an increasing-width shape i.e. a funnel shape. If crystals having such a shape are formed, the particle size of the crushed powder is not uniform. In addition, it is also understood that the problem of an increasing particle size also occurs.

In the present invention, if the P and/or S content of the raw material alloy is less than 100 ppm, the effects of the decrease in the viscosity of the molten alloy cannot be sufficiently expressed, whereby the effects of an improvement in coercive force cannot be attained. On the other hand, if the P and/or S content is too great, the raw material alloy microstructure is too fine, whereby the particle size after pulverizing is also too fine. As a result, orientation during compacting in a magnetic field is inadequate, giving rise to the risk of a deterioration in the residual magnetic flux density. Therefore, the P and/or S content of the raw material alloy according to the present invention is between 100 and 950 ppm. A preferable P and/or S content contained in the raw material alloy is between 200 and 750 ppm, and a more preferable content is between 300 and 700 ppm.

The raw material alloy according to the present invention preferably has a composition comprising 25 to 35% by weight of R, 0.5 to 4% by weight of B, 0.02 to 0.6% of one or both of Al and Cu, 2% by weight or less of one of more of Zr, Nb and Hf, 5% by weight or less of Co, and the balance of Fe and unavoidable impurities. Below, each element will be described.

The raw material alloy according to the present invention comprises from 25 to 35% of R.

Here, as described above, R may include Y, and may be one or more elements selected from the group consisting of La, Ce, Pr, Nd, Sm, Eu, Gd, Tb, Dy, Ho, Er, Yb, Lu and Y. Among R, the facts that Nd is abundant as a natural resource and relatively inexpensive make Nd preferable to use as the main component of R. Moreover, incorporating a heavy rare earth element is effective in strengthen the anisotropic magnetic field to improve coercive force. Accordingly, the raw material alloy according to the present invention can also be made to comprise a heavy rare earth element. Although one or more elements selected from the group consisting of Dy, Tb, Gd, Ho, Er, Tm and Y can be used as the heavy rare earth metal, using Dy and/or Tb is preferable.

If the R content is less than 25.0% by weight, the formation of the $R_2T_{14}B$ grains which serve as the main phase of the R-T-B system sintered magnet is insufficient, whereby α-Fe or the like having soft magnetism segregates, and the coercive force thereby significantly decreases. On the other hand, if the R content exceeds 35% by weight, the volume ratio of the $R_2T_{14}B$ grains constituting the main phase decreases, whereby the residual magnetic flux density decreases. Further, if the R content exceeds 35% by weight, R reacts with oxygen, whereby the oxygen content increases, resulting in the R-rich phase which is effective in coercive force generation decreasing, thereby causing a decrease in coercive force. Therefore, the R content is set between 25.0% and 35.0% by weight. A preferable R content is between 26.0% and 33.0% by weight, and a more preferable R content is between 27.0% and 32.0% by weight.

If incorporating a heavy rare earth element, the heavy-rare-earth-element-containing R is set to between 25 and 35% by weight. In this range the heavy rare earth element content is preferably between 0.1 and 8% by weight. The heavy rare earth element content is preferably determined within the above-described range depending on whether more importance is placed on residual magnetic flux density or coercive force. That is, if a high residual magnetic flux density is desired, the heavy rare earth element content is preferably set between 0.1 and 3.5% by weight, and if a high coercive force is desired the heavy rare earth element content is preferably set between 3.5 and 8% by weight.

The raw material alloy according to the present invention comprises 0.5% to 4.0% by weight of boron (B). If the B content is less than 0.5% by weight, an R-T-B system sintered magnet having a high coercive force cannot be obtained. However, if the B content exceeds 4.0% by weight, the residual magnetic flux density of the R-T-B system sintered magnet tends to decrease. Accordingly, the upper limit is set at 4.0% by weight. The B content is preferably between 0.5% and 1.5% by weight, and more preferably between 0.8% and 1.2% by weight.

The raw material alloy according to the present invention can be made to comprise one or more of Al and Cu in the range of 0.02% to 0.6% by weight. Incorporating one or more of Al and Cu in this range allows greater coercive force, higher corrosion resistance and improved temperature properties of the obtained R-T-B system sintered magnet. If adding Al, a preferable amount is between 0.03 and 0.3% by weight, and a more preferable Al amount is between 0.05 and 0.25% by weight. If adding Cu, the Cu amount is between 0.01 and 0.3% by weight; a preferable amount being between 0.02 and 0.2% by weight, and a more preferable Cu amount being between 0.03 and 0.15% by weight.

The raw material alloy according to the present invention can be made to comprise 5% by weight of Co. Co has an effect in increasing the Curie temperature and improving corrosion resistance of the R-T-B system sintered magnet. By adding in combination with Cu, Co also has the effect of broadening the aging treatment temperature range so that a high coercive force can be obtained. However, excessive addition not only lowers the coercive force of the R-T-B system sintered magnet, but also raises the production cost, the Co content should be set at 5% by weight or less. A preferable Co content is between 0.2 and 4% by weight, and a more preferable Co content is between 0.2 and 1.5% by weight.

The raw material alloy according to the present invention may comprise 2% by weight or less of one or more of Zr, Nb and Hf. When lowering the oxygen content in order to improve the magnetic properties of the R-T-B system intered magnet, Zr, Nb and Hf exhibit an effect in suppressing abnormal grain growth during the sintering process, whereby the microstructure of the sintered body can be made uniform and fine. Therefore, the one or more of Zr, Nb and Hf have a dramatic effect when the oxygen content is low. A preferable content of the one or more Zr, Nb and Hf is between 0.05 and 1.5% by weight, and a more preferable content is between 0.1 and 0.5% by weight.

The R-T-B system sintered magnet prepared using a raw material alloy according to the present invention has a main phase of grains comprising an $R_2T_{14}B$ compound, and further comprises a grain boundary phase. This grain boundary phase comprises several phases, including a "Nd rich phase" so named because it is richer in Nd content than the main phase, a "B rich phase" so named because it is rich in B content, and a oxide phase comprising a compound which comprises R and oxygen. Further, the R-T-B system sintered magnet prepared using a raw material alloy according to the present invention preferably comprises between 10 and 220 ppm of P and/or S. As described above, although the P and/or S contained in the raw material alloy decreases as a result of sintering, if the P and/or S content in the raw material alloy is 100 ppm or greater it is difficult for the P and/or S in the sintered body to decrease below 10 ppm. On the other hand, if more than 220 ppm of P and/or S is contained in the R-T-B system sintered magnet, the decrease in residual magnetic flux density is dramatic. A preferable P and/or S content in the R-T-B system sintered magnet is between 50 and 200 ppm, and a more preferable P and/or S content in the R-T-B system sintered magnet is between 50 and 180 ppm.

The R-T-B system sintered magnet prepared using a raw material alloy according to the present invention preferably has an oxygen content of 3,000 ppm or less. If the oxygen content is large, the non-magnetic component oxide phase increases, causing the magnetic properties to deteriorate. Accordingly, the oxygen content contained in the sintered body is set to be 3,000 ppm or less, preferably 2,000 ppm or less, and more preferably 1,000 ppm or less. However, a simple decrease in the oxygen content causes the oxide phase, which has a grain growth suppressing effect, to decrease to an insufficient level, whereby abnormal grain growth can easily occur during the process for obtaining sufficient density increase when sintering. Thus, in such a low oxygen content, it is preferable to incorporate in the raw material alloy a certain amount of the one or more of Zr, Nb and Hf, which exhibit an effect in suppressing abnormal growth of the main phase grains during the sintering process.

Next, a preferable embodiment of the method for producing an R-T-B system sintered magnet which employs a raw material alloy according to the present invention will be explained.

The raw material alloy can be obtained by strip casting a raw material metal in a vacuum or inert gas, preferably an Ar gas atmosphere. Examples of a raw material metal which can be used for obtaining the raw material alloy include rare earth metals or rare earth alloys, pure iron, ferroboron, as well as alloys thereof and the like. At this stage it is necessary to select the raw material metal so that the P and/or S content in the raw material alloy to be obtained is between 100 and 950 ppm. Since P and/or S are elements which are present in the raw material metal, e.g. pure iron, as impurities, the raw material alloy according to the present invention can be obtained by selecting the impurity level of the raw material metal. The P and/or S content according to the present invention can also be obtained by adding P and/or S as appropriate, without selecting the impurity level of the raw material metal. That is, the required amount of P and/or S can be incorporated as a molten alloy.

After the raw material alloy has been prepared, it is milled. The milling process comprises a crushing process (i.e., coarse milling process) and a pulverizing process (i.e., fine milling process). First, each mother alloy is crushed to a particle size of approximately several hundreds of μm. The crushing is preferably carried out in an inert gas atmosphere, using a stamp mill, a jaw crusher, a brown mill or the like. It is effective to carry out the crushing after hydrogen has been occluded to improve the crushability. The crushing can also be performed without using mechanical means by releasing hydrogen after carrying out hydrogen occlusion. To obtain good magnetic properties, the atmosphere in each step from the pulverizing treatment (recovery after the pulverizing treatment) until sintering (charging into the sintering furnace) is preferably suppressed to an oxygen content of less than 100 ppm. By doing this the oxygen content contained in the sintered body can be controlled to 3,000 ppm or less.

Hydrogen occlusion can be carried out by exposing the raw material alloy to a hydrogen-containing atmosphere at room temperature. Since the hydrogen occlusion reaction is an exothermic reaction, means for cooling the reaction vessel can be utilized in order to prevent the amount of occluded hydrogen from decreasing as a consequence of the rising temperature. The raw material alloy having the occluded hydrogen forms cracks along, for example, the grain boundary.

Once the hydrogen occlusion has been completed, the raw material alloy having the occluded hydrogen is heated for a while for dehydrogenation. This treatment is carried out for the purpose of decreasing the hydrogen which would become impurities in the magnet. The heating retention temperature is 200° C. or greater, and preferably 350° C. or greater. The retention time changes depending on the relationship with the retention temperature, the thickness of the raw material alloy and such factors, but is at least 30 minutes or more, and is preferably 1 hour or more. The dehydrogenation treatment is carried out in a vacuum or under an Ar gas flow. It can be mentioned that the dehydrogenation treatment is not an essential treatment.

The crushing process is followed by a pulverizing process. A jet mill is mainly used in the pulverizing, wherein crushed powder with a particle size of approximately several hundreds of μm is pulverized to a mean particle size of between 3 and 5 μm. Employing the raw material alloy according to the present invention enables a pulverized powder to be obtained which is fine and has a narrow particle size distribution. Jet milling is a method which generates a high-speed gas flow by releasing a high-pressure inert gas (e.g. nitrogen gas) from a narrow nozzle. The crushed powder is accelerated by this high-speed gas flow, causing crushed powder particles to collide with each other, a target, or the container wall, whereby the powder is pulverized. A fine powder having high orientation during compacting can be obtained by adding at the pulverizing stage about 0.01 to 0.3% by weight of an additive such as zinc stearate or the like.

Next, the pulverized alloy powder is compacted in a magnetic field in a state such that its crystal axes are aligned by the magnetic field application. The compacting pressure during the compacting in a magnetic field can be set in a range of 0.3 to 3 ton/cm$^2$. The compacting pressure may be fixed from compacting start to finish, or may be gradually increased or decreased, or may even irregularly change. Although the lower the compacting pressure is the better orientation becomes, if the compacting pressure is too low the strength of the compacted body is inadequate, which gives rise to handling problems. Thus, taking this point into consideration, compacting pressure is selected within the above range. The final relative density of the compacted body obtained from compacting in a magnetic field is, usually, from 50 to 60%. The applied magnetic field can be set at around 12 to 20 kOe. The applied magnetic field is not limited to a static magnetic field, and can be a pulse magnetic field. Further, a static magnetic field and a pulse magnetic field can be used in combination.

Subsequent to the compacting in a magnetic field, the compacted body is sintered in a vacuum or an inert gas atmosphere. While the sintering temperature needs to be adjusted depending on various conditions such as composition, milling method, difference in particle size and particle size distribution, the sintering may be carried out at 1,000° C. to 1,200° C. for about 1 to 10 hours. During this sintering process the P and/or S contained in the raw material alloy decreases. Control of the amount that decreases is not entirely clear, although it has been confirmed that the P and/or S decrease amount tends to increase the higher the sintering temperature and the longer the sintering time.

After sintering is completed, the obtained sintered body may be subjected to an aging treatment. The aging treatment is important for controlling coercive force. If the aging treatment is carried out in two stages, it is effective to retain the sintered body for prescribed lengths of time at around 800 to 900° C. and around 600 to 700° C.

EXAMPLE 1

A high purity Fe raw material was prepared. A raw material alloy was prepared by strip casting having a composition comprising 26.5% by weight of Nd, 5.9% by weight of Dy, 0.25% by weight of Al, 0.5% by weight of Co, 0.07% by weight of Cu, 1% by weight of B and the balance being Fe. P (phosphorous) and S (sulfur) were appropriately added at this stage, whereby raw material alloys having different P and S contents were prepared.

Next, after hydrogen was occluded into the raw material alloys at room temperature, a hydrogen crushing treatment was carried out in an Ar atmosphere for 600° C.×1 hour dehydrogenation. A lubricant (0.05 to 0.1% by weight) for aiding in improving crushing performance and orientation during compacting was added to the alloys which had undergone the hydrogen crushing treatment. Mixing of the lubricant can, for example, be carried out for between 5 and 30 minutes using a Nauter mixer or similar apparatus. After the mixing, pulverizing was performed under fixed conditions, whereby pulverized powder were obtained having a mean particle size of between 4 and 5 μm. The pulverizing was conducted using a jet mill. All the composition samples underwent pulverizing under the same conditions. FIG. 1 illustrates the particle size of the pulverized powders as measured by a laser diffraction particle size distribution analyzer. FIG. 2 illustrates the relationship between P and/or S content in the raw material alloys and D50. The term "D10" refers to the particle size where the cumulative volume of the measured pulverized powder particle size distribution is 10%, "D50" is where the cumulative volume is 50%, and "D90" is where the cumulative volume is 90%.

The obtained pulverized powders were compacted in a 15 kOe magnetic field at a pressure of 1.4 ton/cm$^2$. The obtained compacted bodies were sintered by raising the temperature to 1,080° C. in a vacuum and maintaining for 4 hours. The obtained sintered bodies were subsequently subjected to a two-stage aging treatment consisting of treatments of 800° C. for 1 hour and 560° C. for 1 hour (both in an Ar atmosphere).

The sintered body compositions were measured by fluorescent X-ray analysis as well as P and/or S content in the sintered body. FIG. 1 illustrates the results regarding P and/or S content. The composition of the sintered body alloy elements was 26.2% by weight of Nd, 5.8% by weight of Dy, 0.25% by weight of Al, 0.5% by weight of Co, 0.07% by weight of Cu, 1% by weight of B and the balance of Fe. After grinding the sintered bodies into a certain shape, the magnetic properties were measured. These results are illustrated in FIG. 1. In addition, the relationship between P and/or S content in the sintered body and coercive force (iHc) is illustrated in FIG. 3, and the relationship between P and/or S content in the sintered body and residual magnetic flux density (Br) is illustrated in FIG. 4.

As illustrated in FIG. 1, it can be seen that the P and/or S contained in the raw material alloy considerably decreases as a result of undergoing sintering.

It can further be seen from FIGS. 1 and 2 that if the P and/or S content in the raw material alloy increases, the particle size of the pulverized powder decreases. In addition, if the P and/or S content increases the D90 minus D10 margin decreases, whereby it can be understood that the particle size distribution of the pulverized powder is narrow and sharp.

Figure 3:
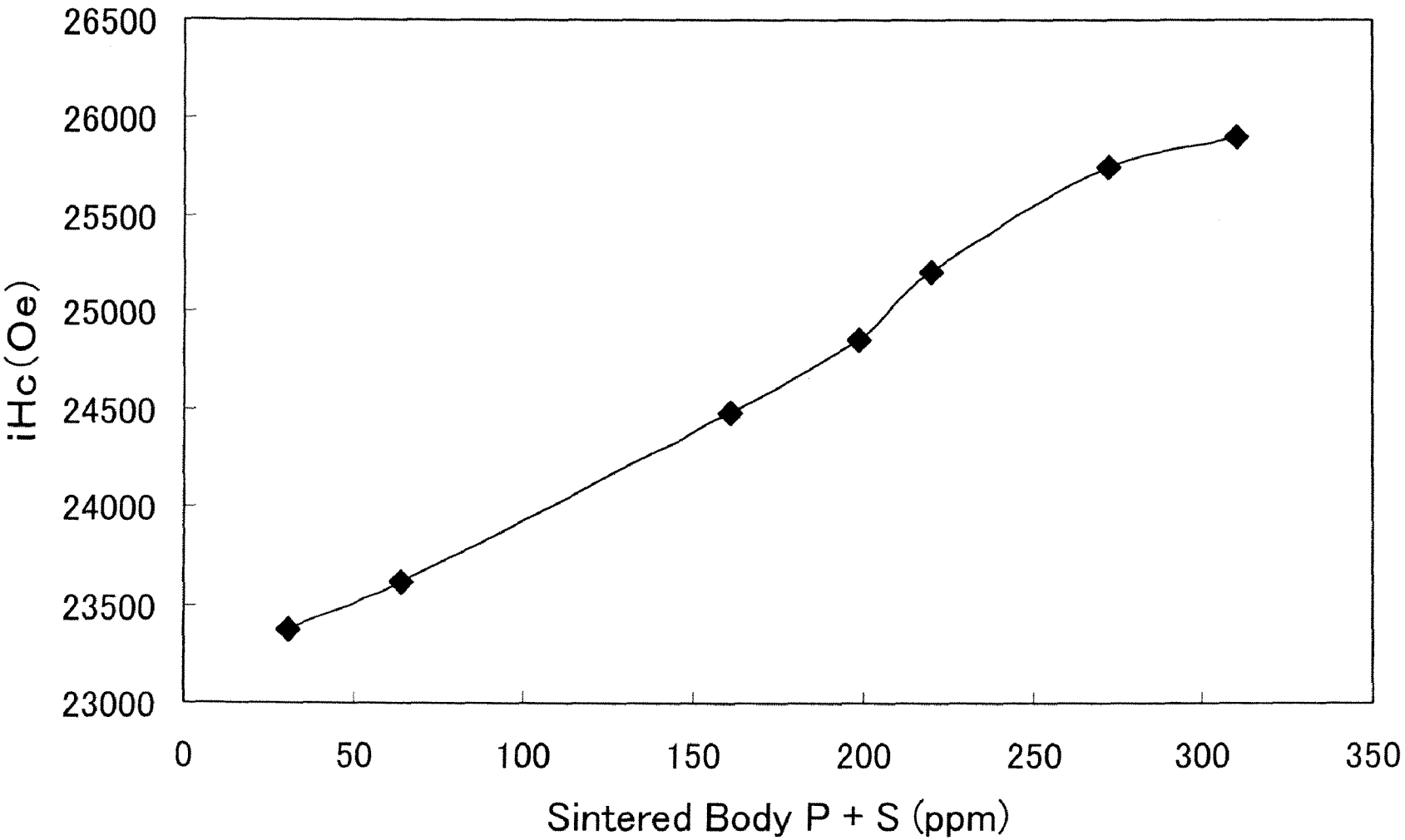
FIG. 3 is a graph illustrating the relationship between P and/or S content in the sintered body of Example 1 and coercive force (iHc)
Figure 4:
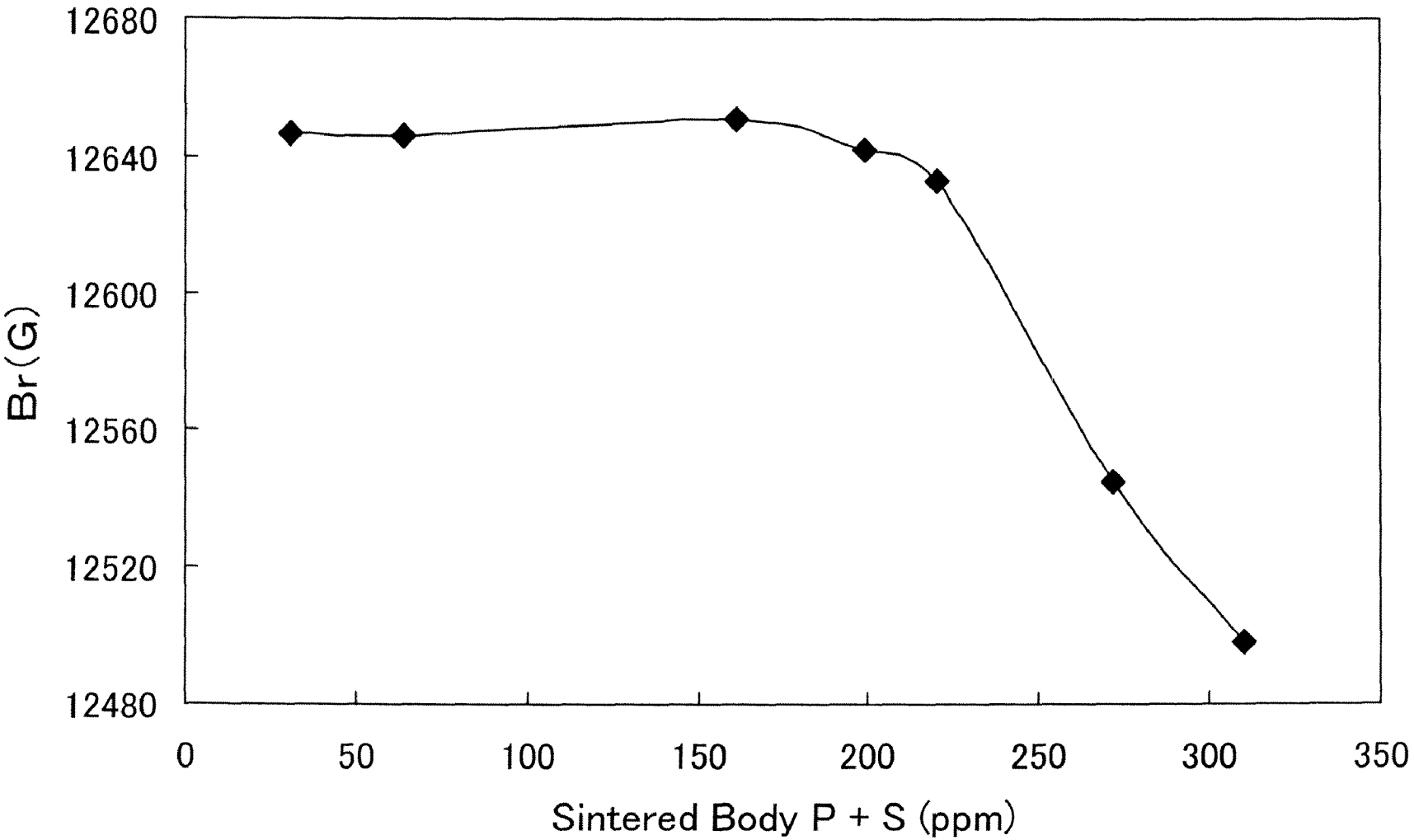
FIG. 4 is a graph illustrating the relationship between P and/or S content in the sintered body of Example 1 and residual magnetic flux density (Br)

From FIGS. 1 and 3 it can be seen that if the P and/or S content in the sintered body, or in other words the P and/or S content in the raw material alloy, increases, coercive force (iHc) increases. On the other hand, from FIGS. 1 and 4 it can be seen that if the P and/or S content in the sintered body increases, the residual magnetic flux density (Br) stays unchanged or slightly increases, and falls dramatically above 220 ppm.

As explained above, a greater the P and/or S content in the raw material alloy allows for a pulverized powder which is finer and has a narrower particle size distribution to be obtained. Further, if the P and/or S contained in the sintered body exceeds beyond a certain amount, magnetic properties, especially residual magnetic flux density (Br), deteriorate. However, since the P and/or S contained in the raw material alloy decreases as a result of undergoing sintering, in the present invention an R-T-B system sintered magnet having high magnetic properties can be obtained while also obtaining a pulverized powder which is fine and has a narrow particle size distribution.

EXAMPLE 2

Figure 6:
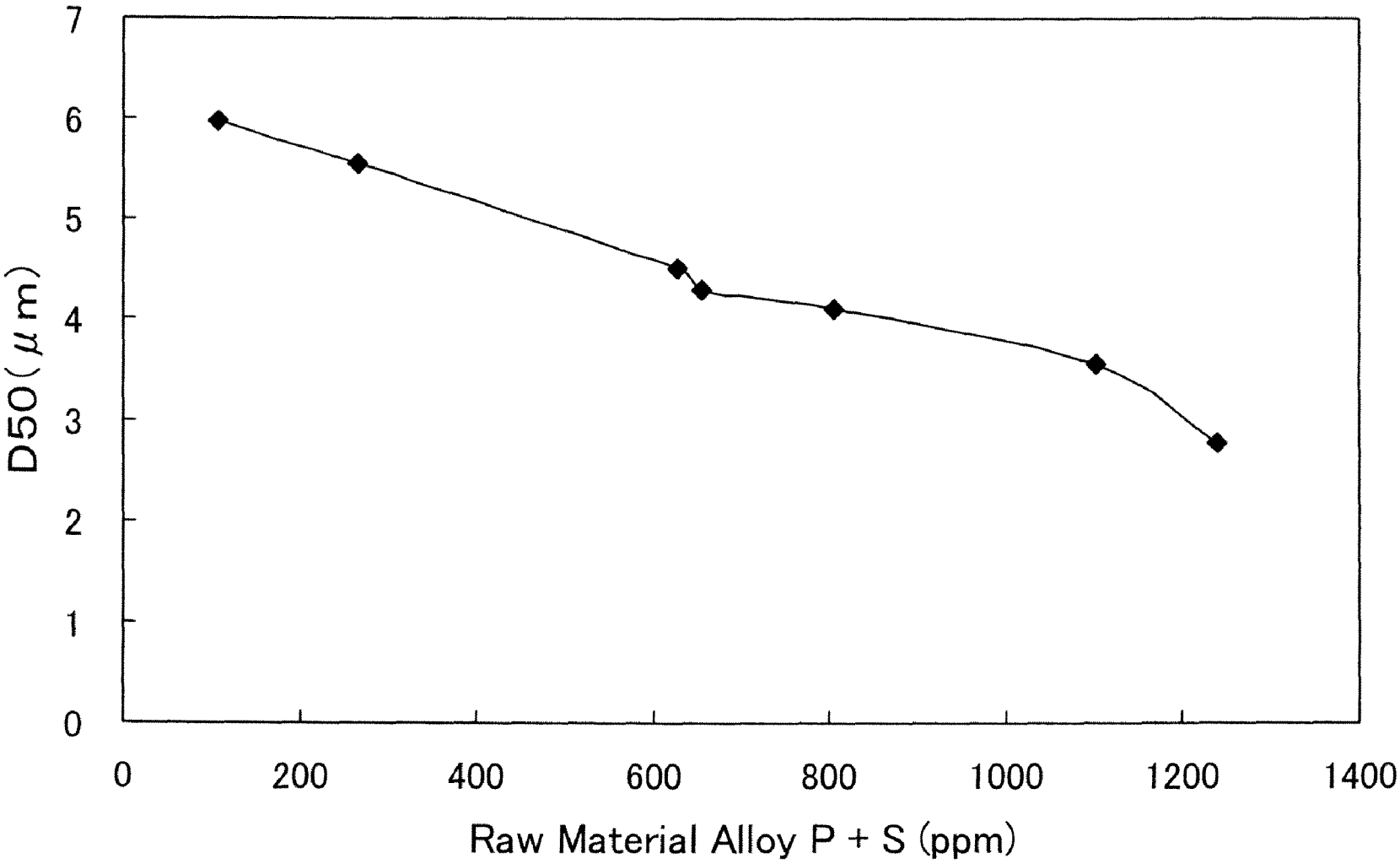
FIG. 6 is a graph illustrating the relationship between P and/or S content in the raw material alloy of Example 2 and D50.
Figure 7:
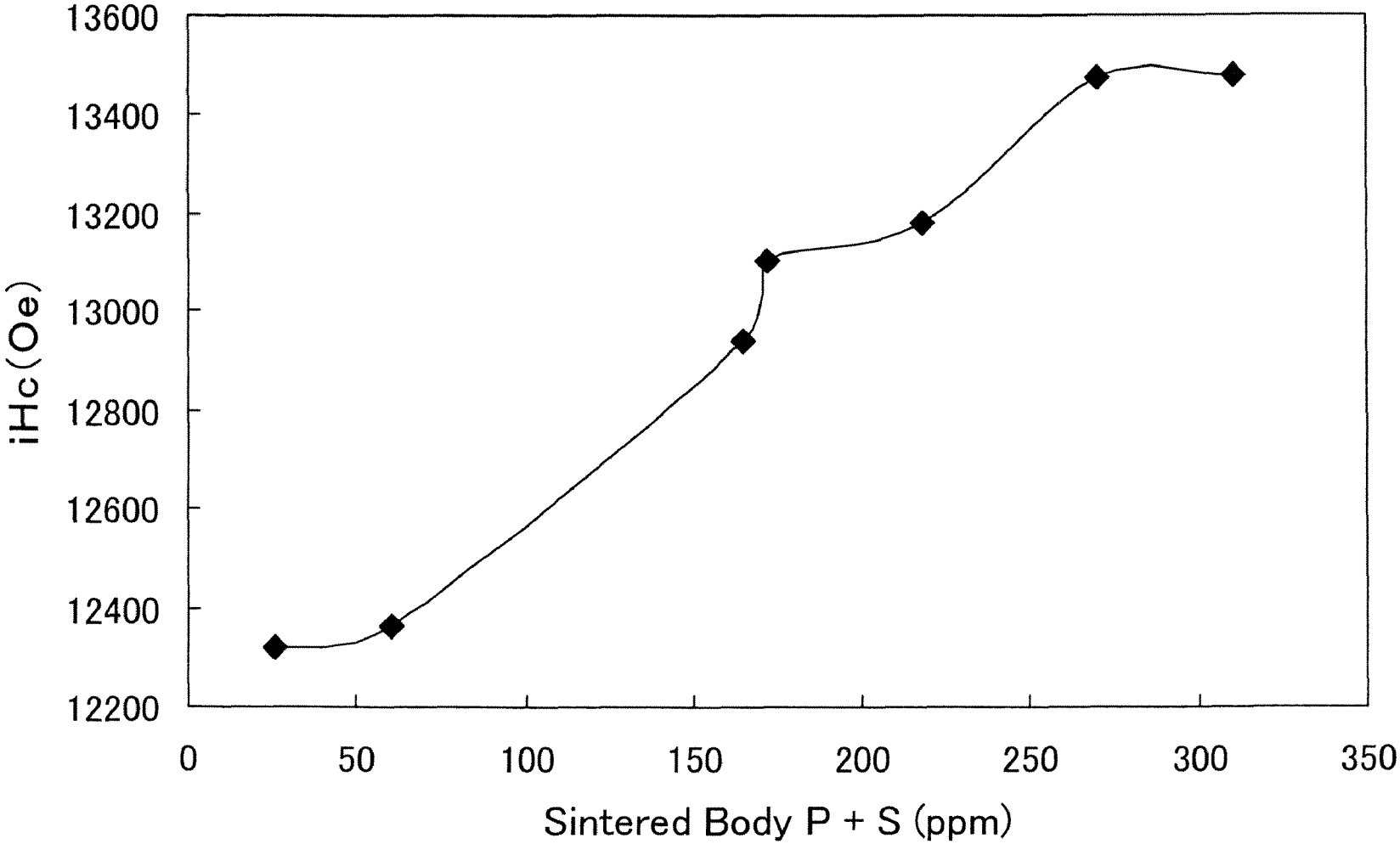
FIG. 7 is a graph illustrating the relationship between P and/or S content in the sintered body of Example 2 and coercive force (iHc)
Figure 8:
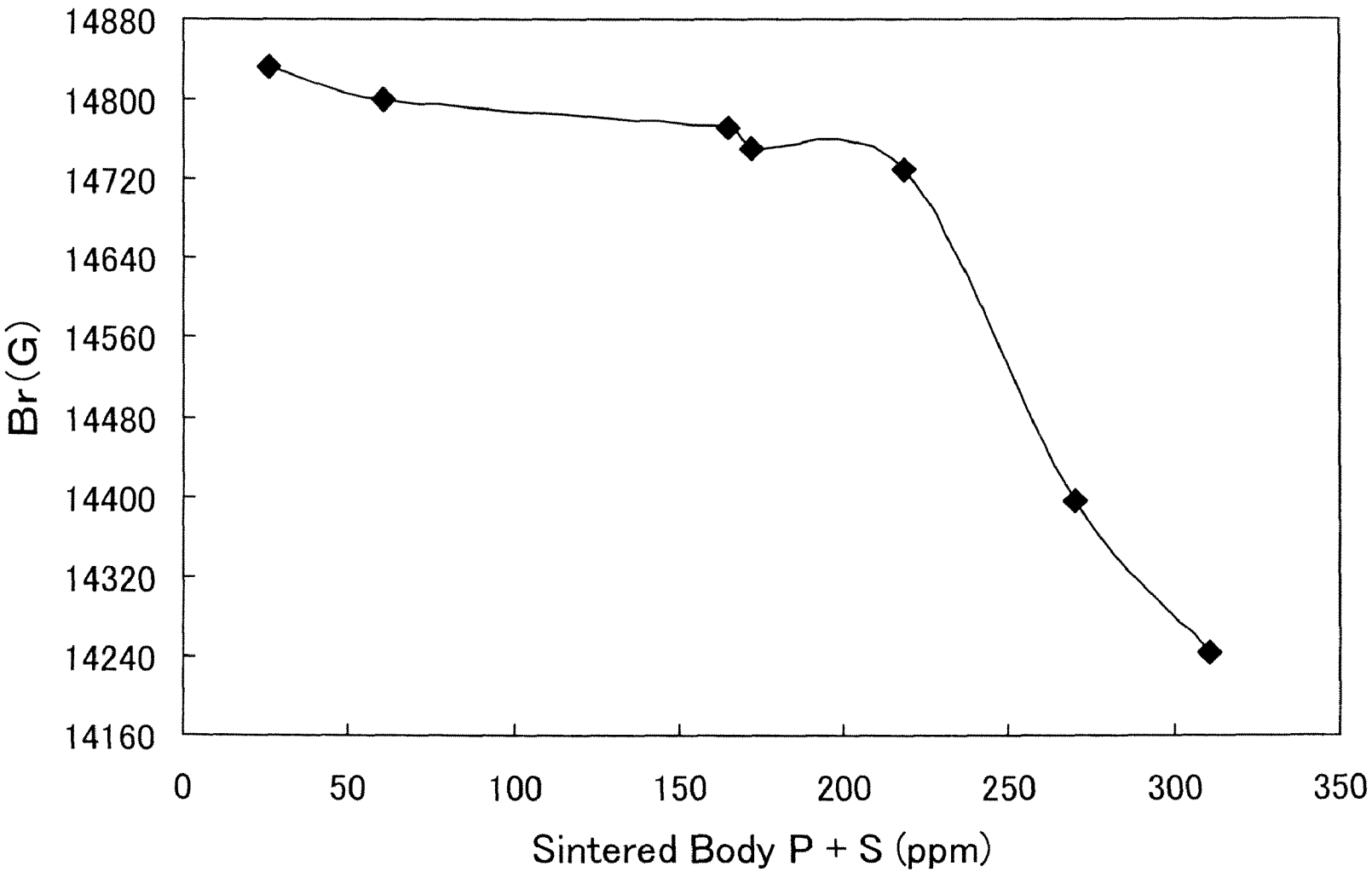
FIG. 8 is a graph illustrating the relationship between P and/or S content in the sintered body of Example 2 and residual magnetic flux density (Br)

Sintered bodies were prepared in the same manner as in Example 1, except that the raw material alloys were made to have a composition comprising 28.6% by weight of Nd, 0.2% by weight of Dy, 0.05% by weight of Al, 0.2% by weight of Co, 0.03% by weight of Cu, 1% by weight of B, 0.08% by weight of Zr and the balance of Fe, the atmosphere in each step from the pulverizing treatment (recovery after the pulverizing treatment) until sintering (charging into the sintering furnace) was suppressed to an oxygen content of less than 100 ppm, and the sintering temperature was set at 1,070° C. During this process the particle size of the pulverized powders was measured in the same manner as in Example 1. Further, the obtained sintered bodies were also measured in the same manner as in Example 1. The results are illustrated in FIG. 5. FIG. 6 illustrates the relationship between P and/or S content in the raw material alloy and D50. FIG. 7 illustrates the relationship between P and/or S content in the sintered body and coercive force (iHc). FIG. 8 illustrates the relationship between P and/or S content in the sintered body and residual magnetic flux density (Br). The composition of the obtained sintered body alloy elements was 28.3% by weight of Nd, 0.2% by weight of Dy, 0.05% by weight of Al, 0.2% by weight of Co, 0.03% by weight of Cu, 1% by weight of B, 0.08% by weight of Zr and a balance of Fe. The O content was 770 ppm.

In Example 2 as well, it can be seen that the P and/or S in the raw material alloy considerably decreases as a result of undergoing sintering. In addition, it can also be seen that if the P and/or S content in the raw material alloy increases, the particle size of the pulverized powder decreases, and the D90 minus D10 difference decreases, whereby it can be understood that the particle size distribution of the pulverized powder is narrow and sharp.

It was found that if the P and/or S content in the sintered body, or in other words the P and/or S content in the raw material alloy, increases, coercive force (iHc) increases, although the residual magnetic flux density (Br) stays unchanged or slightly increases, and falls dramatically above 220 ppm.

EXAMPLE 3

Figure 10:
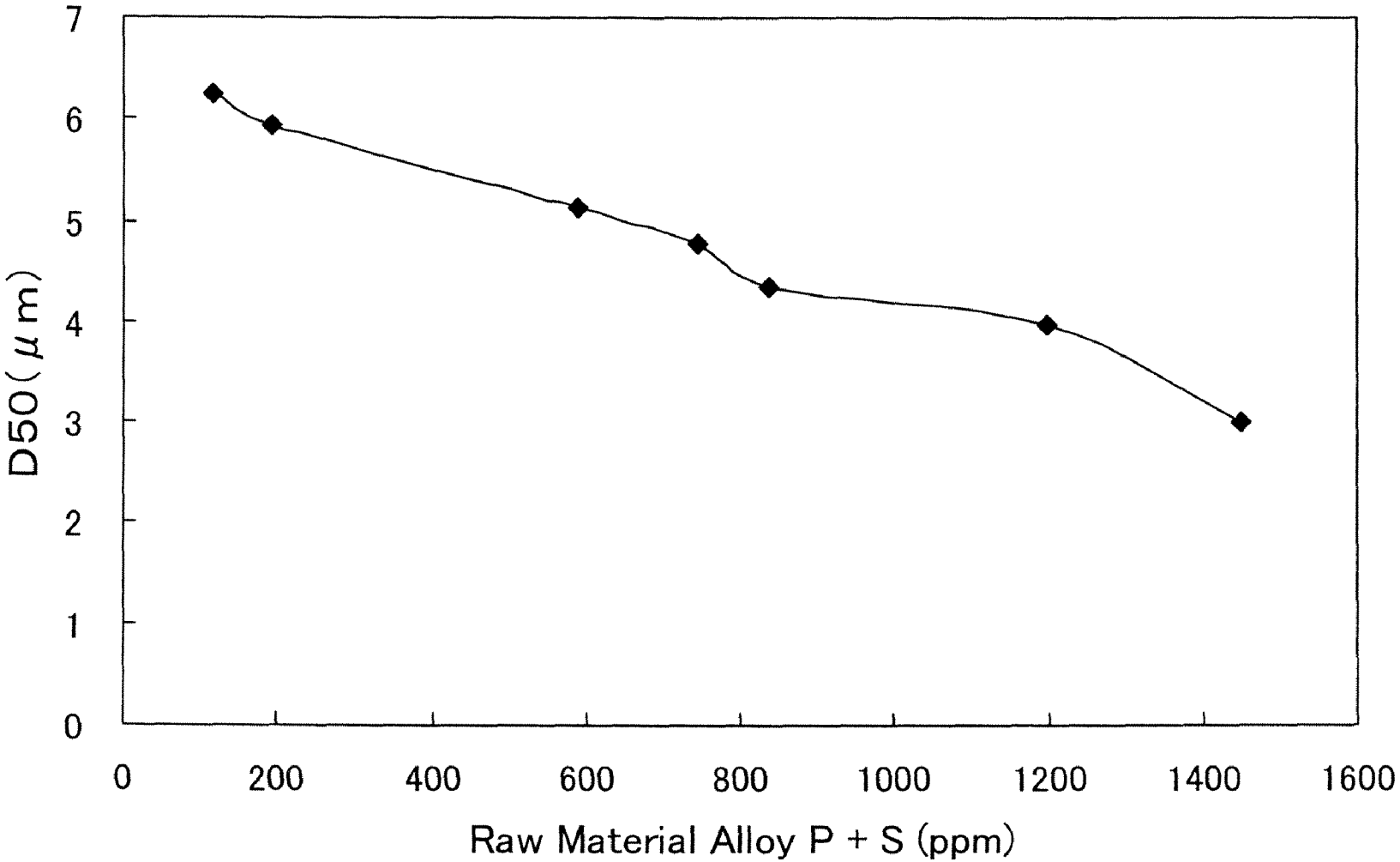
FIG. 10 is a graph illustrating the relationship between P and/or S content in the raw material alloy of Example 3 and D50.
Figure 11:
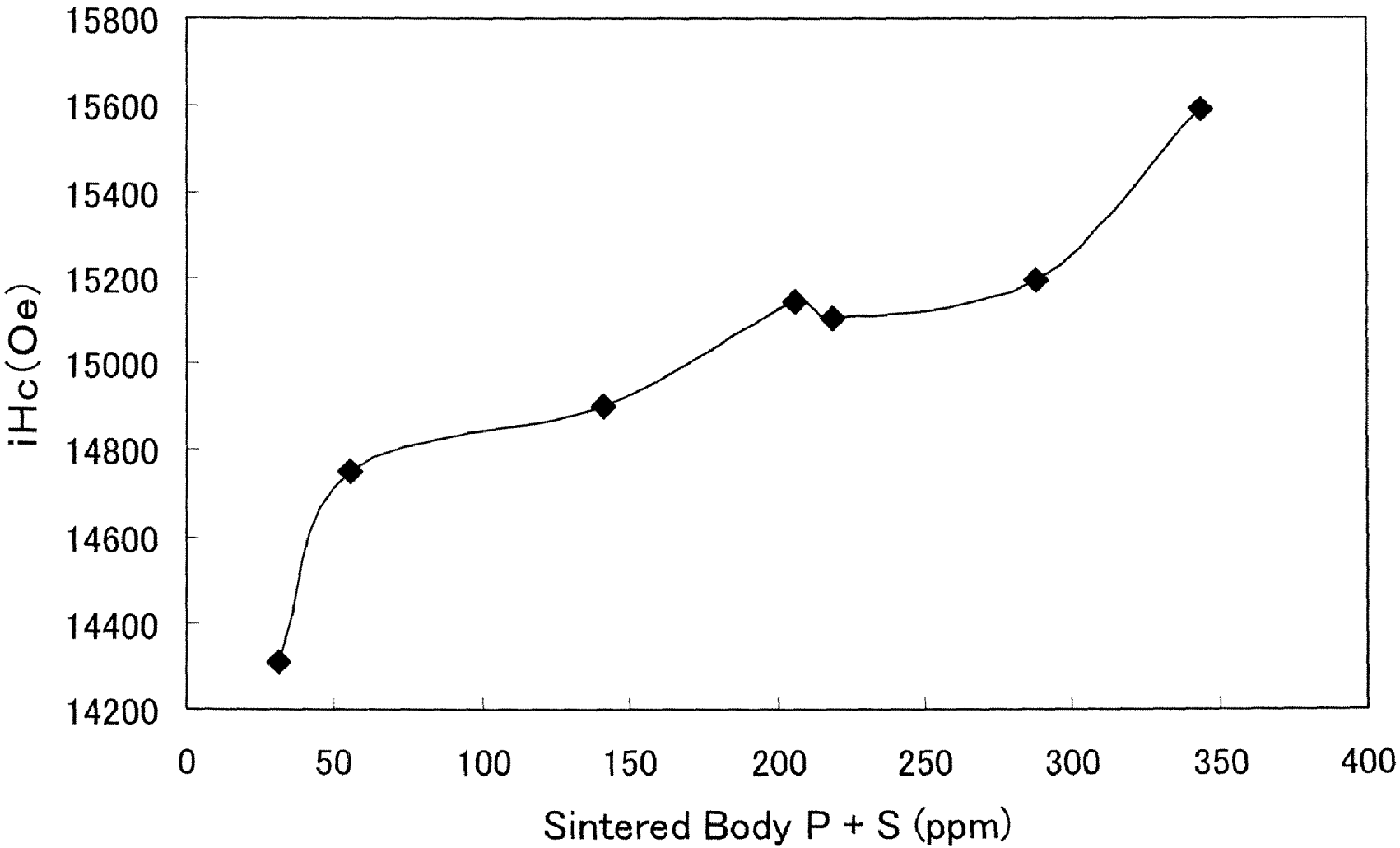
FIG. 11 is a graph illustrating the relationship between P and/or S content in the sintered body of Example 3 and coercive force (iHc)
Figure 12:
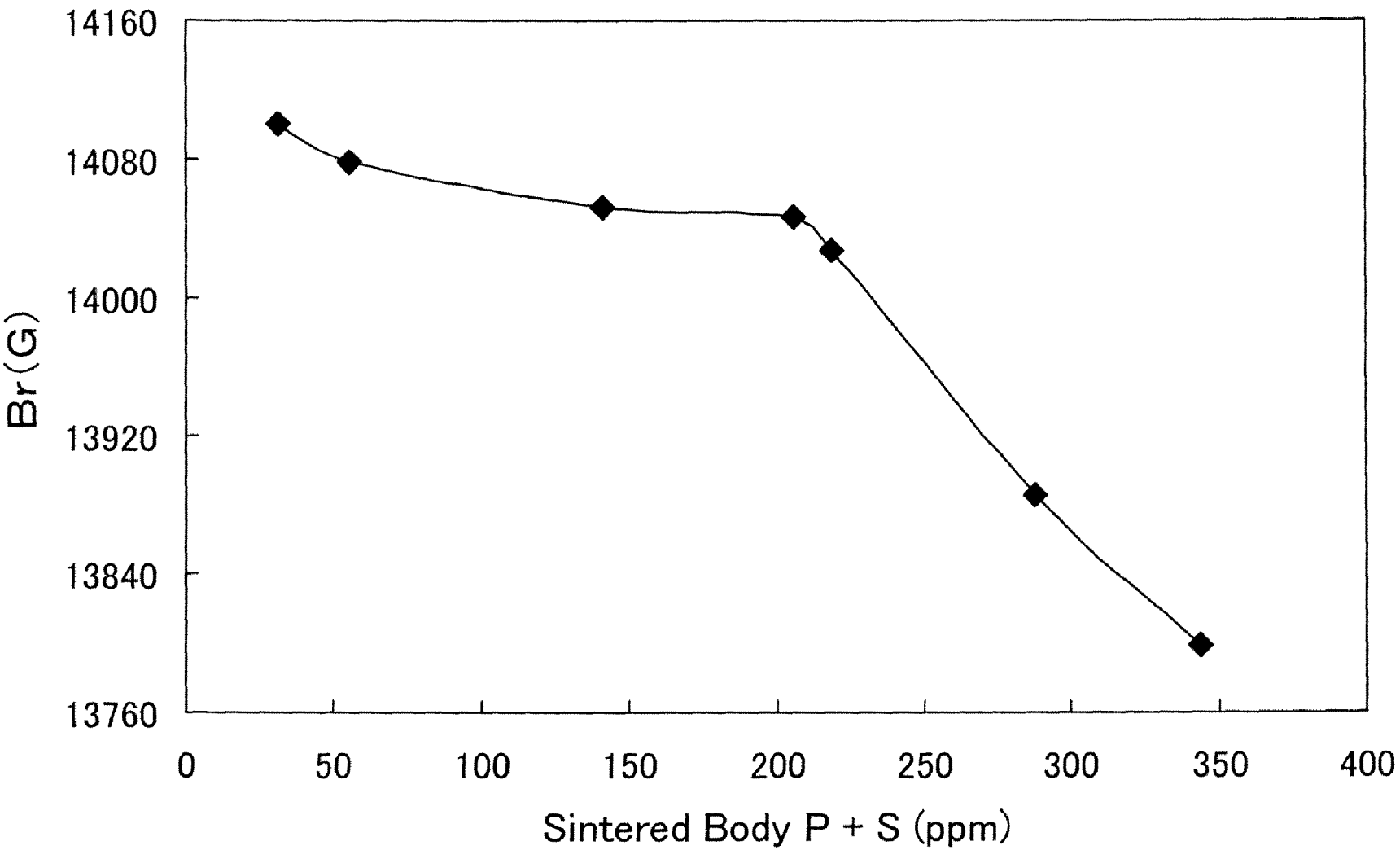
FIG. 12 is a graph illustrating the relationship between P and/or S content in the sintered body of Example 3 and residual magnetic flux density (Br).

Sintered bodies were prepared in the same manner as in Example 1, except that the raw material alloys were made to have a composition comprising 27.2% by weight of Nd, 4.9% by weight of Pr, 0.2% by weight of Dy, 0.25% by weight of Al, 4.0% by weight of Co, 0.3% by weight of Cu, 1.3% by weight of B, 0.25% by weight of Zr and the balance of Fe, the atmosphere in each step from the crushing treatment (recovery after the crushing treatment) until sintering (charging into the sintering furnace) was suppressed to an oxygen content of less than 100 ppm, and the sintering temperature was set at 1,020° C. The obtained sintered bodies were measured in the same manner as in Example 1. The results are illustrated in FIG. 9. FIG. 10 illustrates the relationship between P and/or S content in the raw material alloy and D50. FIG. 11 illustrates the relationship between P and/or S content in the sintered body and coercive force (iHc). FIG. 12 illustrates the relationship between P and/or S content in the sintered body and residual magnetic flux density (Br). The composition of the obtained sintered body alloy elements was 26.9% by weight of Nd, 4.8% by weight of Pr, 0.2% by weight of Dy, 0.25% by weight of Al, 4.0% by weight of Co, 0.3% by weight of Cu, 1.3% by weight of B, 0.25% by weight of Zr and the balance of Fe. The O content was 970 ppm.

From FIGS. 9 to 12 it was confirmed that Example 3 also illustrated the same trend as that shown in Examples 1 and 2.

What is claimed is:

1. A method for producing an R-T-B sintered magnet, comprising a sintered body having grains comprising an $R_2T_{14}B$ compound as a main phase, and comprising steps of:

strip casting a raw material metal to prepare a raw material alloy having a total of P and S content between 100 and 950 ppm;

milling the raw material alloy into a powder having a prescribed particle size;

compacting the powder in a magnetic field to fabricate a compacted body; and sintering the compacted body to obtain the sintered body having a total of P and S content between 10 and 220 ppm, wherein R represents one or more elements selected from rare earth elements, and T represents one or more elements selected from transition metal elements and comprises Fe, or Fe and Co.

2. The method according to claim 1, wherein the sintered body has a composition essentially consisting of 25 to 35% by weight of R, 0.5 to 4% by weight of B, 0.02 to 0.6% by weight of one or both of Al and Cu, 5% by weight or less of Co, and the balance of Fe, both of P and S between 10 and 220 ppm and unavoidable impurities.

3. The method according to claim 1, wherein the raw material alloy is milled to have an average particle size of 3.5 to 6.24 μm.

4. The method according to claim 1, wherein the method further comprises a step of subjecting the sintered body to a two-stage aging treatment.

5. The method according to claim 4, wherein the aging treatment is carried out at a temperature of about 800 to 900° C. and a temperature of about 600 to 700° C.

6. The method according to claim 2, wherein the R includes a heavy rare earth element, and the heavy rare earth element content is between 0.1 and 8% by weight.

7. The method according to claim 1, wherein the method further comprises a step of recovering the powder, wherein each of the steps from the recovering step until charging the compacted body in a furnace in the sintering step is carried out in an atmosphere having an oxygen content of less than 100 ppm.

* * * * *